United States Patent [19]

Verdesca

[11] 4,270,821

[45] Jun. 2, 1981

[54] CABINET AND SHELF WALL MOUNTING APPARATUS

[76] Inventor: Joseph T. Verdesca, 6504 Lobello Dr., Dallas, Tex. 75261

[21] Appl. No.: 53,944

[22] Filed: Jul. 2, 1979

[51] Int. Cl.[3] ..... A47G 29/02

[52] U.S. Cl. ..... 312/245; 248/224.4; 248/225.2

[58] Field of Search ..... 248/201, 205, 224.4, 248/225.2, 243; 52/26, 34; 312/242, 245, 108, 111; 108/107-110

[56] References Cited

U.S. PATENT DOCUMENTS

| | | | |
|---|---|---|---|
| 2,761,640 | 9/1956 | Frater | 248/224.4 |
| 3,260,559 | 7/1966 | Newman et al. | 312/245 |
| 3,347,187 | 10/1967 | Khoury | 312/245 |
| 4,013,254 | 3/1977 | Boundy et al. | 312/245 |
| 4,018,340 | 4/1977 | Gold | 108/108 |

*Primary Examiner*—Casmir A. Nunberg

*Attorney, Agent, or Firm*—Richards, Harris & Medlock

[57] ABSTRACT

An apparatus for mounting a cabinet, shelves or other wall unit (10) on an interior wall (12) includes a pair of rigid support members (26) which are preferably of hollow construction and rectangular cross-section. Each support member (26) is secured to the wall (12) with a plurality of longitudinally spaced fasteners (28) such that the rear side thereof firmly engages the wall. Shoulder fasteners (32) are mounted at spaced intervals along the front sides of said support members (26) for engagement with slotted connector plates (36) secured to the side panels (16) of the unit (10).

7 Claims, 8 Drawing Figures

CABINET AND SHELF WALL MOUNTING APPARATUS

TECHNICAL FIELD

The present invention relates generally to a structural support. More particularly, this invention concerns a support apparatus for mounting cabinets or shelves on an interior wall of a building.

BACKGROUND ART

Cabinets or shelves are often mounted on the interior walls of buildings. Interior building walls, however, are typically constructed of wallboard, plasterboard, sheetrock or other material structurally modest in nature. The structural characteristics of interior walls have therefore been the critical factor in determining the maximum weight which can be safely supported thereby.

Various devices have been developed for mounting cabinets or shelves on a wall. Cabinets are relatively heavier in general, and it has been common practice to mount cabinets by securing them directly to studs or structural members hidden behind the wall. Shelving, of course, can also be mounted in this manner. This mounting technique requires determination of the exact locations of the studs, a procedure typically involving formation of several pilot holes through the wall. Spacing between the studs, however, is not necessarily compatible with the type unit desired to be mounted. Flexibility in positioning the unit on the wall is thus limited by the locations of the support members, and substantial damage to the wall is usually caused by removal of the cabinets or shelving.

Another approach has been to utilize brackets or the like which are received by slotted members attached vertically to the wall only. U.S. Pat. No. 693,127 contains an example of an adjustable bracket which is fairly typical of this approach. While these types of wall mountings afford more placement flexibility, their load-bearing capacity has never been substantial. In addition, these type mountings have an "add-on" look and thus detract from the appearance of the wall and the entire room.

There is thus a need for a new and improved apparatus of greater load-bearing capacity for mounting cabinets, shelves or the like onto a wall.

DISCLOSURE OF INVENTION

The present invention comprises a mounting apparatus which overcomes the foregoing and other problems associated with the prior art. In accordance with the invention, there is provided an apparatus which reacts loading into a wall such that greater loads can be supported by a wall comprised of wallboard, plasterboard, sheetrock or the like. Loads over 200 pounds have been supported on wallboard with the mounting system herein. The present invention permits mounting of cabinets or shelves without reference to support members behind the wall, and lends a built-in appearance to the installation of such units.

In accordance with more specific aspects of the invention, the mounting apparatus herein includes a pair of rigid support members of elongate construction, each support member having two substantially flat surfaces on opposite sides thereof. In the preferred construction, the support members comprise lengths of tubular material square or rectangular in cross-section. The support members are secured to the wall in mutually spaced apart relationship such that the inner surface of each member engages the wall. Rigid side members are then secured to the support members such that the end surface of each side member contacts the outer surface of each support member. Shelves can be suspended between the side members, or the side members can be incorporated into a cabinet. The load is reacted into the wall in a mode which permits the mounting apparatus herein to support loads greater than were heretofore possible without direct connection to structural members behind the wall.

BRIEF DESCRIPTION OF DRAWINGS

A more complete understanding of the invention can be had by referring to the following Detailed Description in conjunction with the accompanying Drawings, wherein.

DETAILED DESCRIPTION

Figure 1:
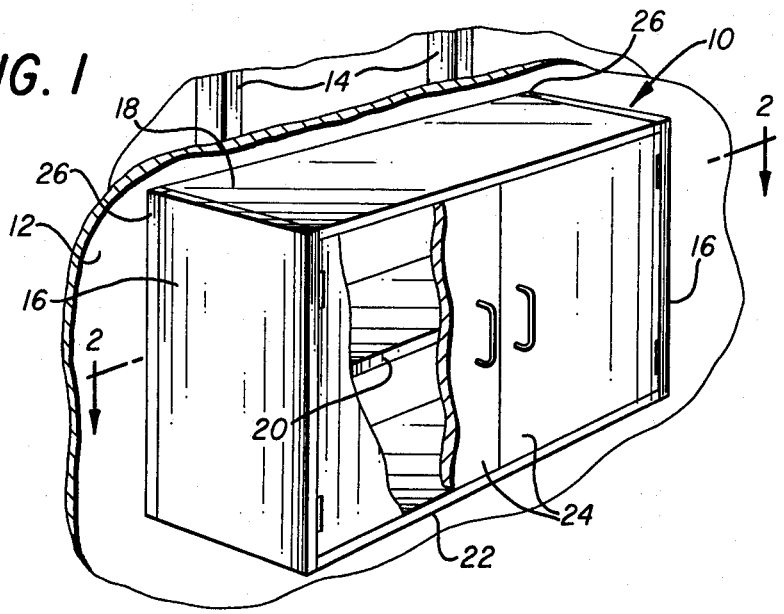
FIG. 1 is a perspective view of a wall cabinet supported by the mounting apparatus of the invention.
Figure 3:
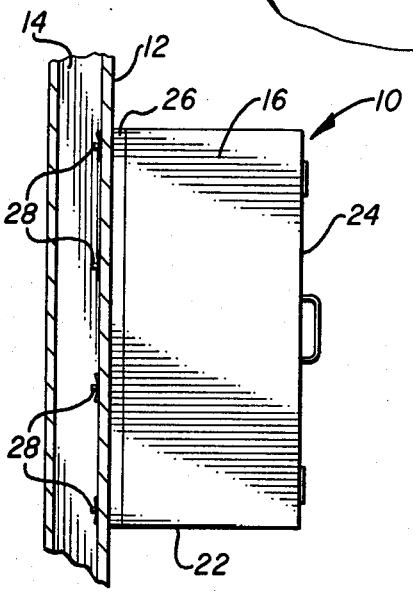
FIG. 3 is an end view of FIG. 1.
Figure 2:
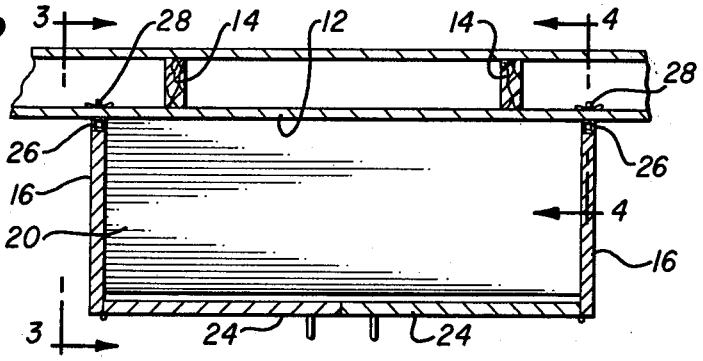
FIG. 2 is a section view taken along lines 2—2 of FIG. 1 in the direction of the arrows.

Referring now to the Drawings, wherein identical reference numerals designate like or corresponding parts throughout the several views, and particularly referring to FIGS. 1–3, there is shown a cabinet 10 which is mounted on a wall 12 comprised of wallboard, plasterboard, sheetrock or the like. Wall 12 is attached to vertically extending studs 14 comprising some of the structural members of the building within which the interior wall is located. Cabinet 10 includes a pair of side panels 16 interconnected by top panel 18, shelf 20 and bottom panel 22. A pair of hinged doors 24 are mounted on the front of cabinet 10.

Cabinet 10 is mounted on wall 12 alone by support members 26 comprising the invention herein.

The mounting apparatus of the invention permits wall 12 alone to support loads greater than were heretofore possible without direct connection to studs 14. As will be more fully explained hereinafter, support members 26 react the weight of cabinet 10 into wall 12 in a manner which advantageously utilizes the structural properties of the wall and permits greater loads to be supported thereby. Loads of up to 200 pounds or more have been supported on an interior wall of wallboard by means of the invention. In addition, the mounting apparatus of the invention lends a built-in appearance to cabinet 10 or other mounted unit.

Figure 4:
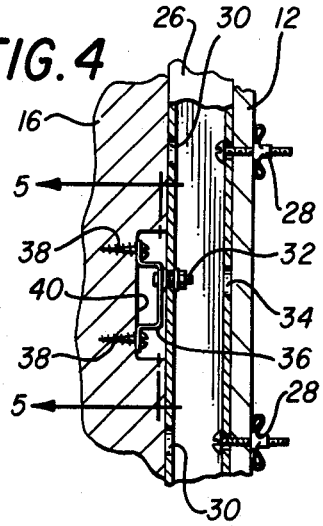
FIG. 4 is an enlarged partial section view illustrating details of the first embodiment of the invention.
Figure 5:
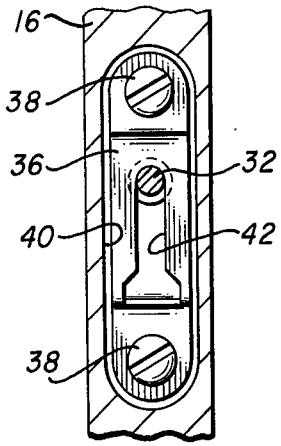
FIG. 5 is a section view taken along lines 5—5 of FIG. 4 in the direction of the arrows.

The constructional details of the invention are best illustrated in FIGS. 4 and 5. In the preferred embodiment, support member 26 comprises a straight length of rigid, tubular material having substantially flat surfaces on opposite sides thereof. Each support member 26 may be comprised of rectangular or square aluminum tubing, for example.

Each support member 26 is secured to wall 12 by a plurality of fasteners 28 located at spaced intervals along the member. As illustrated, four fasteners 28 are utilized for each support member 26 with each fastener extending through wall 12 and being secured on the reverse side thereof. Fasteners 28 preferably comprise bolts or screws and expandable nuts. Fasteners of the type sold under the trademark MOLLY or other suitable connectors can be used for fasteners 28. Access openings 30 are provided in the opposite side of each support member 26 adjacent fasteners 28 so that the support members can be firmly secured to wall 12. It will thus be apparent that each support member 26 is engaged against wall 12 over an area extending the entire length and width of each support member by a plurality of fasteners 28 reaching through the wall and a portion of each member.

A plurality of upset fasteners 32 are mounted at spaced intervals along the opposite side of support members 26. As illustrated, three fasteners 32 can be provided on each support member 26. Fasteners 32 preferably comprise shoulder screws or bolts, washers and nuts. Access holes 34 are provided adjacent fasteners 32 along the inner side of support member 26 so that the fasteners can be mounted on each support member before attachment to wall 12. It will be understood that fasteners 32 are provided on each support member 26 before attachment thereof to wall 12.

Each fastener 32 engages a slotted bracket 36 secured by screws 38 to one of the side panels 16. Brackets 36 are mounted in recesses 40 formed in the ends of side panels 16 so that the end surfaces of side panels 16 are flush with the outside surfaces of support members 26. Each bracket 36 includes a conventional keyhole slot 42 having a lower wide portion which receives the head of one of the fasteners 32, and an upper narrow portion which receives the neck of the fastener when cabinet 10 is moved downwardly. If desired, clips of the type shown in U.S. Pat. No. 3,491,820 can be used for brackets 36.

It will thus be apparent that rigid side panels 16 contact support members 26 substantially continuously along the entire length and width of each member and are interconnected therewith at a plurality of points. As a consequence, the weight of cabinet 10 is reacted by support members 26 into wall 12 primarily in the shear mode with minimal tension and torsion stresses on the wall to provide increased loading capacity without exceeding the structural limitations of the wall.

Figure 6:
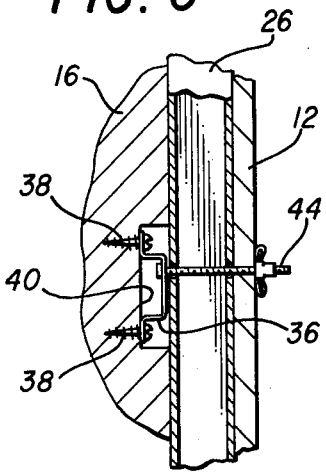
FIG. 6 is an enlarged partial section view illustrating details of a second embodiment of the invention.

FIG. 6 illustrates a second embodiment of the mounting apparatus of the invention, wherein the functions of fasteners 28 and 32 have been combined in a plurality of fasteners 44. Fasteners 44 extend through member 26 and wall 12, and preferably comprise shoulder bolts or screws and expandable nuts. Use of fasteners 44 thus eliminates the need for access holes 30 and 34.

Figure 7:
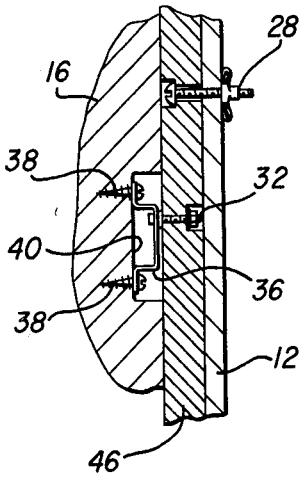
FIG. 7 is an enlarged partial section view illustrated details of a third embodiment of the invention.

FIG. 7 illustrates a third embodiment of the mounting apparatus according to the present invention. If desired, rigid support members 46 of solid construction can be employed in place of support members 26. A similar arrangement of fasteners 28 and 32 and slotted brackets 36 are used for coupling side panels 16 to wall 12. Support members 46 are sufficiently thick for rigidity, and so that the heads of fasteners 28 and the nuts 36 of fasteners 32 can be countersunk therein as it is preferred. If desired, fasteners 44 can be employed with member 46. Otherwise, support members 46 engage side panels 16 and wall 12 substantially continuously along the width and length of opposite sides of each member and function to react the load into the wall primarily in a shear mode like support members 26 shown in FIGS. 1–6.

Figure 8:
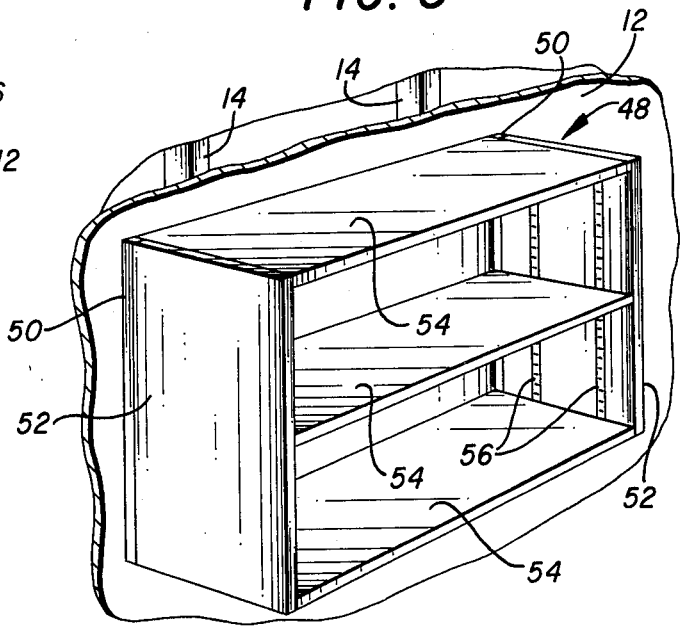
FIG. 8 is a perspective view of wall shelves supported by the mounting apparatus of the invention.

FIG. 8 illustrates a wall shelf 48 mounted on wall 12 by means of support members 50, which may comprise members 26 or 46 disclosed and described herein. Wall shelf 48 includes a pair of rigid side panels 52 interconnected by shelves 54. Shelves 54 are adjustably supported between side panels 52 by guides 56. Side panels 50 are similar in construction to panels 16 of cabinet 10 herein, and include keyhole brackets which engage upset fasteners on the outer surface of support members 48. The mounting system of the invention can thus be used for wall mounting of shelving in addition to cabinets or the like.

From the foregoing, it will be understood that the present invention comprises a mounting apparatus having numerous advantages over the prior art. The apparatus herein reacts load into the wall in a manner which enables support of greater loads than was heretofore possible without direct connection to support structure behind the wall. Greater flexibility in placement of cabinets, shelves or the like on a wall is also achieved. Other advantages will suggest themselves to those skilled in the art.

Although particular embodiments of the invention have been illustrated in the accompanying Drawings and described in the foregoing Detailed Description, it will be understood that the invention is not limited to the embodiments disclosed, but is intended to embrace any alternatives, modifications, and rearrangements and/or substitutions of elements as fall within the scope of the invention.

I claim:

1. Apparatus for mounting a storage unit on a wall, said storage unit being provided with a plurality of apertured connectors, which comprises:

an elongate rigid support member having substantially flat front and rear sides;

a plurality of first fasteners extending through the wall and the rear side of said support member at longitudinally spaced intervals therealong for connecting said support member to the wall such that substantially the entire rear side thereof engages the wall;

said first fasteners including:

an externally threaded member extending through the rear side of said support member and the wall;

an internally threaded member located on the opposite side of the wall and engaged with said externally threaded member; and a plurality of second fasteners extending through the front side of said support member at longitudinally spaced points therealong, each of said second fasteners being adapted for engagement with one of the apertured connectors of the storage unit.

2. The apparatus of claim 1, wherein said support member comprises a straight tubular body of predetermined length and rectangular cross-section.

3. Apparatus for mounting a storage unit on a wall, said storage unit being provided with a plurality of apertured connectors, which comprises:

an elongate rigid support member having substantially flat front and rear sides;

a plurality of first fasteners extending through the wall and the rear side of said support member at longitudinally spaced intervals therealong for connecting said support member to the wall such that substantially the entire rear side thereof engages the wall;

a plurality of second fasteners extending through the front side of said support member at longitudinally spaced points therealong, each of said second fasteners being adapted for engagement with one of the apertured connectors of the storage unit, said second fasteners including:

an externally threaded shoulder member with a neck portion extending outwardly from the front side of said support member and an enlarged head portion at the end of the neck portion; and an internally threaded member located on the opposite side of said support member and engaged with said externally threaded member.

4. For use with a storage unit having at least one shelf connected between a pair of rigid side members, each of said side members having a plurality of slotted connector plates secured thereto, the plates having keyhole shaped slots, an apparatus for mounting the storage unit on a wall comprising:

a pair of elongate rigid support members, each having substantially flat front and rear sides;

a plurality of first fasteners extending through the rear side of each of said support members at longitudinally spaced intervals therealong for securing said support members to the wall;

each of said first fasteners comprising an externally threaded member extending through the rear side of one of said support members and the wall, and an internally threaded member engaged on the externally threaded member and located on the opposite side of said wall; and a plurality of second fasteners attached to the front side of each of said support members at longitudinally spaced intervals therealong, each of said second fasteners being configured to engage one of the slotted connector plates on the side members of the storage unit and each of said second fasteners including a shoulder member having a neck portion extending outwardly from the front side of said support member with an enlarged head portion at the end of the neck portion, said head and neck portions being dimensioned for receipt by opposite ends of the keyhole slot in one of said connector plates.

5. The apparatus of claim 4, wherein each support member comprises a straight tubular body of predetermined length and rectangular cross-section.

6. For use with a storage unit having at least one shelf connected between a pair of rigid side members, each of said side members having a plurality of slotted connector plates secured thereto, an apparatus for mounting the storage unit on a wall comprising:

a pair of elongate rigid support members, each having substantially flat front and rear sides, wherein each support member comprises a tubular body, and wherein said body includes an opening through the front side adjacent each first fastener for access to one end of the externally threaded member of each of said fasteners;

a plurality of first fasteners extending through the rear side of each of said support members at longitudinally spaced intervals therealong for securing said support members to the wall;

each of said first fasteners comprising an externally threaded member extending through the rear side of one of said support members and the wall, and an internally threaded member engaged on the externally threaded member and located on the opposite side of said wall; and a plurality of second fasteners attached to the front side of each of said support members at longitudinally spaced intervals therealong, each of said second fasteners being configured to engage one of the slotted connector plates on the side members of the storage unit.

7. For use with a storage unit having at least one shelf connected between a pair of rigid side members, each of said side members having a plurality of slotted connector plates secured thereto, an apparatus for mounting the storage unit on a wall comprising:

a pair of elongate rigid support members, each having substantially flat front and rear sides, wherein each support member comprises a tubular body, and wherein said body includes an opening through the rear side adjacent each second fastener for access to one end of each of said fasteners;

a plurality of first fasteners extending through the rear side of each of said support members at longitudinally spaced intervals therealong for securing said support members to the wall;

each of said first fasteners comprising an externally threaded member extending through the rear side of one of said support members and the wall, and an internally threaded member engaged on the externally threaded member and located on the opposite side of said wall; and a plurality of second fasteners attached to the front side of each of said support members at longitudinally spaced intervals therealong, each of said second fasteners being configured to engage one of the slotted connector plates on the side members of the storage unit.

* * * * *